US012378849B2

(12) United States Patent
Oag et al.

(10) Patent No.: US 12,378,849 B2
(45) Date of Patent: Aug. 5, 2025

(54) TOOL FOR MANIPULATING MATERIAL USING A PRESSURIZED FUEL AND OXIDANT MIXTURE

(71) Applicant: SPEX OIL & GAS LIMITED, Aberdeen (GB)

(72) Inventors: Jamie Oag, Aberdeenshire (GB); Andrew Forsyth, Westhill (GB); Simon McKay, Banchory (GB); Christoph Kirchberger, Hardthausen (DE); Dominic Freudenmann, Hardthausen (DE); Maxim Kurilov, Hardthausen (DE)

(73) Assignee: SPEX OIL & GAS LIMITED, Aberdeen (GB)

( * ) Notice: Subject to any disclaimer, the term of this patent is extended or adjusted under 35 U.S.C. 154(b) by 230 days.

(21) Appl. No.: 17/619,526

(22) PCT Filed: Jun. 19, 2020

(86) PCT No.: PCT/EP2020/067246

§ 371 (c)(1),
(2) Date: Dec. 15, 2021

(87) PCT Pub. No.: WO2020/254659

PCT Pub. Date: Dec. 24, 2020

(65) Prior Publication Data

US 2022/0307351 A1 Sep. 29, 2022

(30) Foreign Application Priority Data

Jun. 19, 2019 (GB) ..... 1908786

(51) Int. Cl.

| | |
|---|---|
| ***E21B 43/119*** | (2006.01) |
| ***C06B 25/00*** | (2006.01) |
| ***E21B 43/114*** | (2006.01) |

(52) U.S. Cl.
CPC ..... *E21B 43/119* (2013.01); *C06B 25/00* (2013.01); *E21B 43/114* (2013.01)

(58) Field of Classification Search
CPC ..... E21B 43/119; E21B 43/114; C06B 25/00
See application file for complete search history.

(56) References Cited

U.S. PATENT DOCUMENTS

| | | | |
|---|---|---|---|
| 3,539,406 | A | 11/1970 | Lissant |
| 4,008,110 | A | 2/1977 | Machacek |

(Continued)

FOREIGN PATENT DOCUMENTS

| | | | |
|---|---|---|---|
| DE | 1646296 | A1 | 9/1971 |
| EP | 3018112 | A1 | 5/2016 |

(Continued)

OTHER PUBLICATIONS

International Search Report and Written Opinion for corresponding PCT Application No. PCT/EP2020/067246, mailed Nov. 11, 2020.

(Continued)

*Primary Examiner* — Silvana C Runyan
(74) *Attorney, Agent, or Firm* — Tarolli, Sundheim, Covell & Tummino LLP

(57) ABSTRACT

A tool (1), for example, a tool for use downhole in a tubular oil or gas well, and a method of deploying and operating the tool (1), are disclosed herein. The tool (1) includes a generally cylindrical body (4), which includes a chamber (6). A fuel source (8) is also included. The fuel source (8) is a pressurised fuel and oxidant mixture (9) which is released into the chamber by an injector device through injector nozzles (16). The fuel and oxidant mixture (9) is ignited to form a combustion jet (20). The combustion jet (20) exits the nozzle outlet (28) as directed combustion jets, which per- (Continued)

forate the walls of the tubular oil or gas well 30, wherein the walls of the tubular oil or gas well represent a material to be manipulated.

18 Claims, 3 Drawing Sheets

(56) References Cited

U.S. PATENT DOCUMENTS

| | | | | |
|---|---|---|---|---|
| 4,446,920 | A | 5/1984 | Woytek | |
| 2013/0126153 | A1* | 5/2013 | Baker | E21B 33/06 166/55 |
| 2013/0161007 | A1* | 6/2013 | Wolfe | E21B 43/11857 166/63 |
| 2014/0238678 | A1* | 8/2014 | Arrell, Jr. | F42B 1/00 102/292 |
| 2015/0047760 | A1 | 2/2015 | Hahma | |
| 2015/0275643 | A1* | 10/2015 | Holder | E21B 43/263 166/63 |
| 2018/0163496 | A1 | 6/2018 | Oag | |
| 2018/0163497 | A1 | 6/2018 | Younger | |

FOREIGN PATENT DOCUMENTS

| | | | |
|---|---|---|---|
| GB | 2528054 | A | 1/2016 |
| WO | 2016079512 | | 5/2016 |
| WO | 2016166531 | | 10/2016 |
| WO | 2017199037 | A1 | 11/2017 |

OTHER PUBLICATIONS

GB Search Report dated Jul. 30, 2020 for corresponding GB Application No. 2009419.9.

* cited by examiner

TOOL FOR MANIPULATING MATERIAL USING A PRESSURIZED FUEL AND OXIDANT MIXTURE

RELATED APPLICATIONS

The present invention is a U.S. National Stage under 35 USC 371 patent application, claiming priority to Serial No. PCT/EP2020/067246, filed on 19 Jun. 2020; which claims priority from 1908786.5, filed 19 Jun. 2019, which are incorporated herein by reference.

FIELD

The present invention relates to a tool for manipulating a material. The invention finds particular application in the oil and gas industry and is particularly suitable for the manipulation of solid materials for example tubulars, such as casing or production tubing, in a downhole environment.

BACKGROUND

There are situations in which it is desirable to initiate a change in a target material particularly in remote locations such as inside an oil or gas well. The change may be a change to one or more of temperature, structure, position, composition, phase, physical properties and/or condition of the target or any other characteristic of the target.

A typical situation may be to sever a tubular in a well, clean a downhole device or tubulars, initiate a downhole tool or remove an obstruction. Conventional tools perform these operations with varying degrees of success but generally they are not particularly efficient and make such operations expensive and time consuming.

Improved tools such as described in the present applicant's international patent applications WO2016/166531 and WO2016/079512 make use of deflagrating propellants. A deflagrating propellant is generally classified as an explosive material which has a low rate of combustion and once ignited burns or otherwise decomposes to produce propellant gas. This gas is highly pressurised, the pressure driving the gas and other combustion products away from the propellant, forming a stream of combustion products. A propellant can burn smoothly and at a uniform rate after ignition without depending on interaction with the atmosphere and produces propellant gas and/or heat on combustion; and may also produce additional combustion products.

Despite these improvements there remains the need for further tools for downhole or other uses with additional or alternative capabilities.

SUMMARY

According to a first aspect of the invention there is provided a tool for manipulating a material, the tool comprising:

- a body defining a chamber;
- at least one source of a pressurised fuel and oxidant mixture, or of a pressurised monopropellant, in fluid communication with the chamber via an injector device;
- at least one nozzle, each nozzle having an inlet and an outlet, the inlet being in fluid communication with the chamber; and
- at least one mechanism for igniting the fuel and oxidant mixture, or for initiating decomposition of the monopropellant;

- wherein, upon ignition of the fuel and oxidant mixture, or initiating decomposition of the monopropellant, a combustion jet, or decomposition product jet is formed in the chamber which, in use, flows out of the tool through each nozzle outlet towards, and into engagement with, a material to be manipulated.

The tool may be a downhole tool for use in oil and/or gas wells. The manipulation of a material (as the 'target' of the combustion jet or decomposition product jet) may be a change in temperature, structure, position, composition, phase, physical properties and/or condition of the material; or any other characteristic of the material making up the target. The change in the material may be to, for example, ablate, erode, impact, clean and/or transmit heat. Severing or perforating the material of a target e.g. severing a tubular is an exemplary use.

The tool may find use in removing lengths of tubular downhole. The tool may find use in perforating a tubular in multiple locations along its axial length downhole. The removal of lengths of tubular, or perforation of a tubular may be carried out in an ablative fashion. Fuel and oxidant mixtures described herein can act to remove metal from a tubular by ablating it into fine particles or droplets that are blasted away by the combustion jet or by a decomposition product jet from a monopropellant. The metal of the tubular may even be combusted (oxidised) during its removal. Such uses can serve as alternatives to conventional milling techniques that may be relatively expensive and time consuming.

As an alternative the combustion jet or decomposition product jet may be employed to repair a target, for example by depositing a coating carried by the combustion jet. For further example, the combustion jet or decomposition product jet (e.g. the heat produced) may be employed in operations to plug a wellbore or seal a perforation and the like. Repair operations may include providing a cement or a fusible material such bismuth or a bismuth alloy from the tool or from another source.

A suitable monopropellant for use in the tool can be hydrazine or a hydrazine derivative. Catalytic or thermal decomposition of hydrazine produces a decomposition product jet of hot gases that can be directed by the nozzle or nozzles at a target. Alternatively, the tool makes use of a fuel and oxidant mixture to produce a combustion jet.

For simplicity, the text that follows will generally refer only to fuel and oxidant mixtures and resulting combustion jet. However, it will be understood that the alternative—a monopropellant and subsequent decomposition product jet—may be provided and can be employed in similar fashion, unless the context or an explicit statement to the contrary dictates otherwise.

The combustion jet pressurises the chamber. The pressure and/or heat generated maybe employed to open the at least one nozzle. For example, by melting a fusible material that closes the nozzle before use. For further example by moving part of the tool relative to each other and thereby uncovering or creating the nozzle opening.

The nozzle or nozzles may provide a combustion jet or combustion jets emanating from the tool in a radially outwards 360 degree or substantially 360 degree direction i.e. the combustion jet or jets can engage a target, such as a section of a tubular, around the circumference of its inner surface. In a tool with such an arrangement, moving the tool axially within a tubular (following ignition the fuel and oxidant mixture) can remove a selected length of tubular.

The nozzle or nozzles may divide the initially formed combustion jet into a plurality of directed combustion jets, each emanating in a selected direction, outwards from the tool. The combustion jet or jets may be used to perforate a tubular. The perforation(s) may be round or of any shape required for the specific application in question. Any number and combination of perforation shapes may be used in one or more operations. In a tool with such an arrangement, after perforating a tubular at a selected location or locations, the tool may be moved axially to a new location along the length of the tubular to make further perforations. Before moving the tool, the combustion process may be halted and then subsequently restarted after moving the tool to a new location. Alternatively, the combustion process may continue as the tool is being moved.

In addition to moving the tool axially in use, a tool may be rotated. Thus, for example, a tool with a combustion jet emanating in one direction may be rotated so as to direct the jet in different directions around the location of the tool.

Nozzles provided on a tool may be closable. This can be useful, for example where the tool is moved from one location to another during or after use.

The tool may include a cooling system. For example, the cooling system may be open. In an open cooling system, a supply of coolant, such as water or seawater is not reused. After cooling heated parts such as the chamber and nozzle(s) the coolant is allowed out of the tool e.g. dumped into the well when the tool is being used downhole. Alternatively, a cooling system may be closed. In a closed cooling system, the coolant is recirculated. The coolant (such as water or seawater) may pass round a cooling system that may include a cooling unit, to cool coolant after circulation through or past heated parts. As a yet further alternative a flowable fuel such as a liquid, gas, or gel may itself be circulated for use as a coolant, before being fed to the chamber and ignited.

The fuel and oxidant mixture may be supplied as a single composition including both fuel and oxidant. This may be described as a 'mono fuel' system, as only one composition is required to obtain the combustion jet. Alternatively, fuel and oxidant may be provided separately (e.g. from separate tanks within the body of the tool) to be mixed either before or at the ignition point, where the combustion jet is formed in the chamber. Where a separate fuel composition and a separate oxidant composition are employed that arrangement may be termed a 'bi fuel' system.

The fuel and oxidant mixture may be carried within the tool or may be delivered to the tool, via appropriate conduits, from any remote location, for example from storage tanks located on the surface facilities of an offshore oil and gas platform, drilling rig or well intervention vessel or from the seabed. Monopropellants may be supplied similarly.

The combined fuel and oxidant mixtures and the fuels and oxidants employed as separate compositions are combustible but generally not explosive i.e. not classified as explosives ("Class 1") for transport under dangerous goods regulations. This can make handling and transport of these materials, and tools containing these materials, less hazardous and generally simpler. Where separate fuel and oxidant compositions are provided for mixing in the tool, one or both of these may be classified as non-combustible, until the mixture is made.

The fuel may be a solid, liquid, slurry, gel or gas. The oxidant may be a solid, liquid, slurry, gel or gas. Similarly, a monopropellant or mixture of fuel and oxidant might be a solid, liquid, slurry, gel or gas. Advantageously the compositions employed for fuel, oxidant, combined fuel and oxidant mixture, or monopropellant are flowable.

Thus gases, liquids, slurries or gels may be preferred. Solid particles may be contained within liquids, slurries or gels; or even in gases (as an aerosol). Metal particles can serve as a fuel, increasing combustion temperatures and density. In some examples they may act as a catalyst for combustion processes. Alternatively, particulate solids as principal or even sole fuel or oxidant may be contemplated in some instances, for example propelled by gas in the form of an aerosol.

Gel compositions of fuel, oxidant and/or a fuel and oxidant mixture can provide advantages. Gel compositions can have their viscosity controlled to suit delivery and combustion conditions found in the downhole or other relatively harsh environments. Thus, a gel 'mono fuel', or a gel 'bi fuel' where one or both of oxidant composition and fuel composition are gels can be convenient in use.

Examples of fuel substances that may be employed in a fuel or fuel and oxidant composition include ionic liquids, or solutions, comprising quaternary ammonium salts, such as alkyl quaternary ammonium salts, for example ethyl ammonium nitrate.

As an alternative a hydrocarbon composition, such as a paraffin (hydrocarbon) mixture and/or an alcohol and/or a nitro alkane and/or a nitroalkene and/or an alkyl nitrate may be employed in a fuel. In which case the oxidant may be supplied separately (as a 'bi fuel') and may be a gas, such as air or oxygen or a liquid such as cryogenic oxygen or nitric acid. However, a paraffin mixture and/or an alcohol and/or a nitroalkane and/or a nitroalkene and/or an alkyl nitrate may be used as a fuel component or fuel components in mono fuel compositions. Alcohols, nitroalkanes and alkyl nitrates, when employed, may be C1 to C10 alcohols, nitroalkanes and alkyl nitrates.

An example of a fuel and oxidant mixture (mono fuel) is a composition comprising an ionic liquid and a source of additional oxygen, such as a nitrate perchlorate, chlorate, chromate or dinitramide salt, or mixtures thereof. For example lithium nitrate, lithium perchlorate or ammonium dinitramide. Thus, a gel comprising ethyl ammonium nitrate and lithium nitrate is convenient.

A further example of a mono fuel composition is a composition comprising an alcohol, such as ethanol, and a source of additional oxygen, such as a nitrate, perchlorate, chlorate, chromate or dinitramide salt, or mixtures thereof.

A yet further example of a mono fuel composition is a composition comprising a nitroalkane and/or a nitroalkene and/or an alkyl nitrate; and a source of additional oxygen, such as a nitrate, perchlorate, chlorate, chromate or dinitramide salt, or mixtures thereof. If a nitroalkane is used nitromethane may be employed. If an alkyl nitrate is used isopropyl nitrate (IPN) may be used.

Mono fuel compositions suitable for use in the tools of the invention are discussed in more detail below with respect to further aspects of the invention.

Where a gel is desired, any gelling agent compatible with the other components of the composition can serve. Examples of gelling agents that may be employed include polyacrylic acid polymers, such as the Carbopol 6 polymers available from The Lubrizol Corporation of Wickliffe Ohio USA. Alternatives may include fumed silica e.g. Aerosil 6 fumed silicas available from Evonik industries AG of Essen, Germany. More than one gelling agent may be employed.

The fuel and oxidant compositions may have additives to enhance performance in manipulating a target material such as a tubular. For example, particles, such as aluminium or other metal particles may be provided, suspended in a fuel and oxidant mixture, a fuel composition or even an oxidant composition. Gel compositions and mixtures are convenient in avoiding settling out of particles. Metal particles such as aluminium can provide the benefit of increasing the density of fuel compositions allowing the tools and any associated storage tanks to be more compact. Aluminium particles may serve a dual purpose. As a reactive metal aluminium may contribute to the combustion process, forming aluminium oxide. The aluminium itself or the aluminium oxide formed may act as a heat transfer agent or even an abrasive in attacking a target material.

Other reactive metals or elements may be employed in place of or in addition to aluminium. For example, magnesium, iron or boron. Where more than one reactive metal or element is employed, they can be used as mixtures and/or as alloys. For example, magnalium (an alloy of magnesium and aluminium) or other aluminium alloys may be used. Magnalium containing about 5% magnesium and 95% aluminium by weight may be used. More generally the use of one or more of aluminium, beryllium, iron, zirconium, magnesium, boron and/or boron carbide is contemplated.

Where particles are employed in compositions, particles may have diameters of less than 100 μm of even below 60 μm, typically from 10-45 μm. However, for some uses nano-particles may be employed. For example, having diameters of 100 nm or less. Particles may be coated (for example to aid dispersion in a liquid or gel) or uncoated.

Particles may also be supplied separately in the tool for introduction into the combustion jet or for introduction into the fuel, the oxidant or a combined oxidant and fuel composition, before the ignition of the mixture. Conveniently particles may be supplied suspended in a liquid, for example particles such as aluminium particles may be supplied suspended in a liquid or gel phase, for example in dioctyl adipate.

The at least one source provides pressurised fuel and oxidant (together or separately) into the chamber. Where liquids or gels are employed gas pressure may be used to drive the fluid(s) into the chamber. For example, by pressurising a container containing the liquid or gel with an inert gas such as nitrogen. Alternatively, a cylinder contained within or attached to the tool may supply a gas pressure (e.g. of nitrogen). As a further alternative gas pressure may be supplied via hose connections to the tool. Where a solid is employed as fuel or oxidant it may be delivered as a pressurised aerosol. A monopropellant may be supplied in similar ways.

As a yet further alternative one or more pumps may be employed to pressurise the combustion mixture or its separate components. The use of hydraulic or pneumatic systems (e.g. a piston moved by hydraulic fluid) to provide pressure is also contemplated.

The delivery of fuel, oxidant, fuel and oxidant mixture, or monopropellant to the chamber is via an injector device that may control the input to the chamber and may include a mixing head for mixing fuel and oxidant together. Typically, the fuel and oxidant mixture is finely dispersed by the injector device i.e. the injector device comprises a plurality of injector nozzles through which the fuel and oxidant mixture (or components of the mixture) flow before ignition on entry to the chamber. The injector device decouples the combustion jet from the source of pressurized fuel and oxidant mixture.

Ignition may be by any suitable means for the compositions employed. Ignition may be by electrical discharge or laser. As another alternative electrically powered or laser ignition (for example in the chamber) may be used to ignite a primer composition, that ignites more readily than the fuel and oxidant mixture.

Preferred fuel and oxidant systems for use in the tool, especially mono fuel systems are generally not readily ignitable, for safety reasons. Thus, a primer composition such as potassium perchlorate or ammonium perchlorate may be provided in the chamber and ignited to provide an initial combustion, heat and pressure that will ignite the fuel and oxidant supplied to the chamber via the injector device. As an alternative the primer composition may be provided as a charge (or several charges) installed in a separate chamber connected to the combustion chamber.

Once ignited, the fuel and oxidant (e.g. gel fuel and oxidant) will continue to combust as long as it is provided at a suitable rate. The initial ignition sequence associated with the primer composition may be electro-explosive based, using a known RF safe oilfield igniter system. Alternatively, the initial ignition sequence may be delivered using a percussion igniter which is insensitive to electrical impulse, but rather has an impact sensitivity requiring a striking pin to be actuated above it.

A monopropellant such as hydrazine may be ignited by a catalyst or thermally.

The combustion jet may be enhanced or moderated in various ways, in addition to those discussed above making use of particles. The combustion jet may have additional fuel and/or oxidant injected into it from a source, that may be the same source that supplies the fuel and oxidant.

The tool may further comprise one or more control modules, which may control the mono fuel or bi fuel supply, additives supply, combustion chamber pressure and temperature and discharge pressure and temperature. Control modules may contain one or more items such as components for: an electrical or laser ignition system; control of gas pressures (that may be adjustable in response to monitoring of combustion temperatures); and other items such as a pump for pressurising the fuel, the oxidant, or a fuel and oxidant mixture.

According to a second aspect the present invention provides a method of manipulating a material, the method comprising:

deploying a tool according to the first aspect of the invention into the proximity of a target material; and operating the tool to produce at least one combustion jet or decomposition jet that engages the target material.

The method may make use of any embodiments of the tool as described herein. The method may make use of any embodiment of the fuel and oxidant compositions as described herein.

According to a third aspect the present invention provides a fuel comprising an ionic liquid. The ionic liquid may comprise a quaternary ammonium salt such as an alkyl quaternary ammonium salt, or a mixture of quaternary ammonium salts. The quaternary ammonium salt may be ethyl ammonium nitrate.

According to a fourth aspect the present invention provides a fuel comprising a quaternary ammonium salt such as an alkyl quaternary ammonium salt, or a mixture of quaternary ammonium salts. The quaternary ammonium salt may be ethyl ammonium nitrate.

According to a fifth aspect the present invention provides a fuel and oxidant mixture comprising an ionic liquid. The ionic liquid may comprise a quaternary ammonium salt such as an alkyl quaternary ammonium salt, or a mixture of quaternary ammonium salts. The quaternary ammonium salt may be ethyl ammonium nitrate.

According to a sixth aspect the present invention provides a fuel and oxidant mixture comprising a quaternary ammonium salt such as an alkyl quaternary ammonium salt, or a mixture of quaternary ammonium salts as fuel and a nitrate, perchlorate chlorate, chromate or dinitramide salt or mixtures thereof as oxidant. For example, lithium nitrate and/or lithium perchlorate salts may be employed. Mixtures of salts, for example mixtures of nitrate salts, mixtures of perchlorate salts and/or a mixture comprising one or more nitrate salt and one or more perchlorate salt may be employed as oxidant. The quaternary ammonium salt may be ethyl ammonium nitrate. The nitrate salt may be lithium nitrate. The perchlorate salt may be lithium perchlorate.

According to a seventh aspect the present invention provides a fuel and oxidant mixture comprising an alcohol, such as ethanol, as fuel and a nitrate, perchlorate chlorate, chromate or dinitramide salt, or mixtures thereof as oxidant.

According to an eighth aspect the present invention provides a fuel and oxidant mixture comprising a nitroalkane, a nitroalkene, an alkyl nitrate, or mixtures thereof, as fuel and a nitrate, perchlorate chlorate, chromate or dinitramide salt, or mixtures thereof as oxidant. Nitromethane may be used. Isopropyl nitrate may be used.

Examples of fuel and oxidant mixtures (mono fuels) in accordance with the fifth to eighth aspects of the invention and suitable for use in tools of the present invention are described further below. All quantities are given as % by weight of the total composition.

A. Gel fuel and oxidant mixtures may comprise:

from 50 to 70% or even from 55 to 65% by weight of a quaternary ammonium salt ionic liquid;

from 5 to 25% or even from 10 to 20% by weight of a nitrate chlorate, chromate or dinitramide salt, or mixtures thereof;

from 5 to 25% or even from 10 to 20% by weight of at least one metal selected from the group consisting of aluminium, magnesium, and alloys of aluminium and magnesium;

from 0 to 20% or even from 5 to 15% by weight of an alcohol; and from 0.15 to 10% or even from 0.5% to 3% by weight of a gelling agent.

In composition A, the alcohol may be a C1 to C10 alcohol with one or more hydroxyl groups. A glycol or other polyhydric alcohol may be used, for example ethylene glycol. The alcohol can aid in dissolution of the oxidant and lower the freezing point of the composition. A nitrate salt, such as lithium nitrate may be used. The gelling agent may comprise polyacrylic acid polymers and/or fumed silica. If a gel composition is not required, the gelling agent may be omitted. Other additives may be included However, compositions A may consist essentially of or consist only of the components listed above.

A preferred composition A is as follows:

| % by weight | Component |
|---|---|
| 59 | ethyl ammonium nitrate (ionic liquid) |
| 15 | lithium nitrate |
| 15 | aluminium particles |
| 10 | ethylene glycol |
| 1 | Carbolpol ® (polyacrylic acid polymer) |

B. Gel fuel and oxidant mixtures may comprise:

from 30 to 50% or even from 35 to 45% by weight of an alcohol;

from 35 to 55% or even from 40 to 50% by weight of a nitrate, chlorate, chromate, dinitramide or perchlorate salt, or mixtures thereof;

from 5 to 25% or even from 10 to 20% by weight of at least one metal selected from the group consisting of aluminium, magnesium, and alloys of aluminium and magnesium;

and from 0.15 to 10% or even from 0.5% to 3% by weight of a gelling agent.

In composition B the alcohol may be a C1 to C10 alcohol with one or more hydroxyl groups. Ethanol may be used. The salt may be a perchlorate salt such as lithium perchlorate.

The gelling agent may comprise polyacrylic acid polymers and/or fumed silica. If a gel composition is not required, the gelling agent may be omitted. Other additives may be included. However, compositions B may consist essentially of or consist only of the components listed above.

A preferred composition B is as follows:

| % by weight | Component |
|---|---|
| 45 | lithium perchlorate |
| 40 | ethanol |
| 14 | aluminium particles |
| 0.8-1 | Carbolpol ® (polyacrylic acid polymer) |

C. Gel fuel and oxidant mixtures may comprise from 50 to 70% or even from 55 to 65% by weight of a nitroalkane, a nitroalkene, an alkyl nitrate, or mixtures thereof;

from 0 to 20% or even from 1 to 10% by weight of an alcohol;

from 5 to 25% or even from 10 to 20% by weight of at least one metal selected from the group consisting of aluminium, magnesium, and alloys of aluminium and magnesium;

from 10 to 30% or even from 15 to 20% by weight of a nitrate, chlorate, chromate, dinitramide or perchlorate salt, or mixtures thereof; and from 0.15 to 10% or even from 0.5% to 3% by weight of a gelling agent.

In composition C a nitroalkane employed may be a C1 to C10 nitroalkane. A nitroalkene may be a C2 to C10 nitroalkene, for example nitroethylene. The nitroalkane may be nitromethane. If an alkylnitrate is used it may be a C1 to C10 alkyl nitrate such as isopropyl nitrate.

In composition C the alcohol may be a C1 to C10 alcohol with one or more hydroxyl groups. The alcohol may be a butyl alcohol, such as n-butyl alcohol. Butyl alcohol is convenient as it is a commonly employed desensitiser for nitro alkanes.

The salt may be a perchlorate salt such as lithium perchlorate.

The gelling agent may comprise polyacrylic acid polymers and/or fumed silica. If a gel composition is not required, the gelling agent may be omitted. Other additives may be included However, compositions C may consist essentially of or consist only of the components listed above.

A preferred composition C is as follows:

| % by weight | Component |
|---|---|
| 60 | nitromethane |
| 5 | n-butyl alcohol |
| 8 | aluminium particles |
| 18 | lithium perchlorate |
| 4 | magnalium alloy (5% Mg, 95% Al) |

-continued

| % by weight | Component |
|---|---|
| 2 | Aerosil ® (fumed silica) |
| 3 | Carbolpol ® (polyacrylic acid polymer) |

DETAILED DESCRIPTION OF THE DRAWINGS

Figure 1:
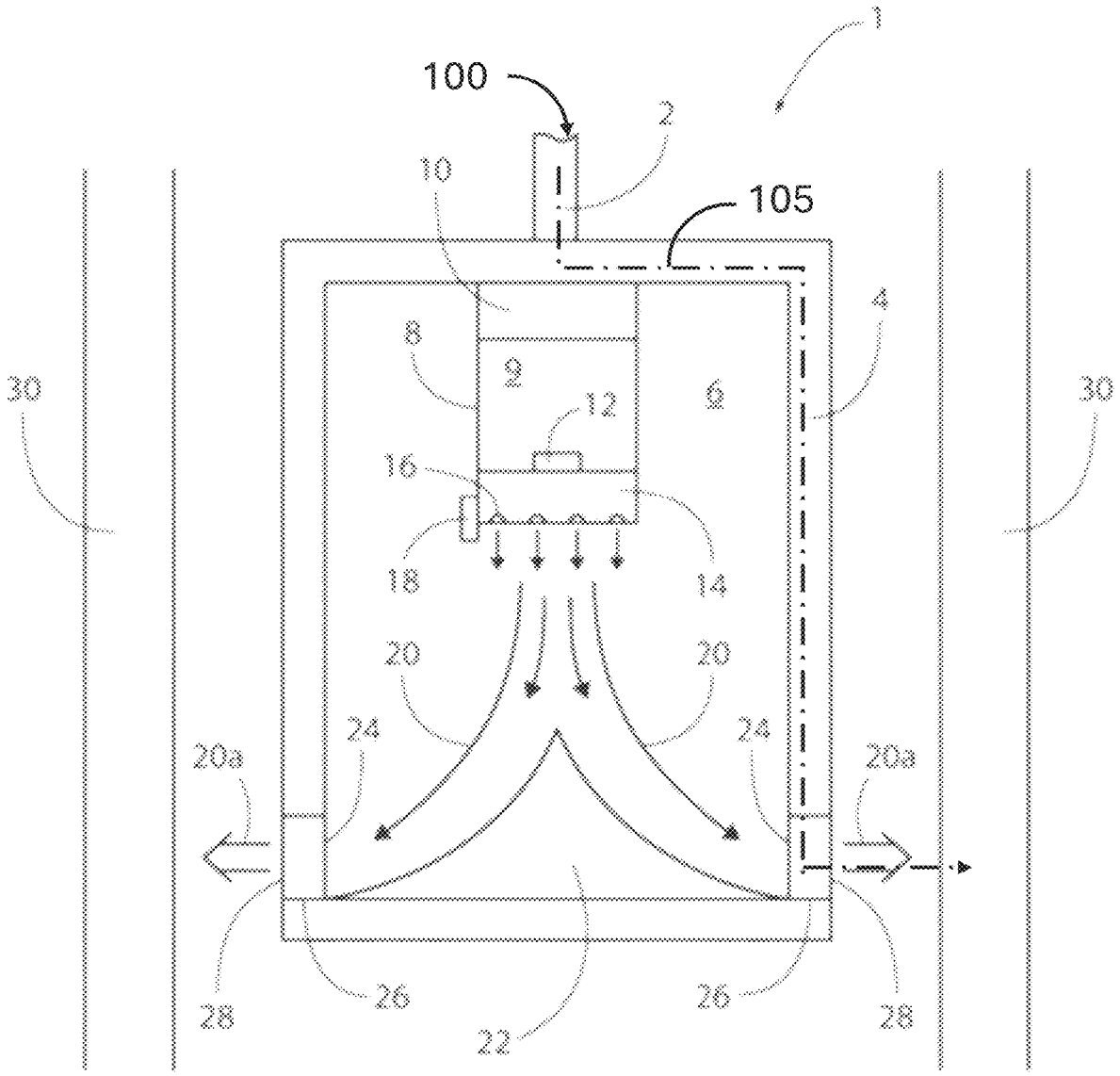
FIG. 1 shows an exemplary tool 1 for perforating a tubular in schematic cross section.

FIG. 1 shows an exemplary tool 1 in schematic cross section. The tool 1 is downhole in an oil or gas well. Connection 2 to surface includes control signal wiring. The tool 1 has a generally cylindrical body 4 including a chamber 6. Within the chamber 6 is a fuel source, a cylinder 8 in this example. Cylinder 8 contains a gel fuel and oxidant mixture 9, pressurised by a charge of nitrogen gas contained within.

A signal sent via the connection to surface 2 operates the control module 10 which commands opening of valve 12, releasing the gel fuel and oxidant mixture 9 into injector head 14. The mixture 9 is sprayed through injector head nozzles 16 into chamber 6 as a finely divided spray. Ignitor 18 provides an electrical discharge that ignites mixture 9 to form a combustion jet suggested by arrows 20. The combustion jet pressurises the chamber 6 and is deflected by deflector 22 towards the inlets 24 of nozzles 26 that are closed by fusible material 28. The heat and pressure from the combustion jet removes the fusible material 24, allowing the combustion jet 20 to escape the chamber 6 via the outlets 28 of nozzles 26 as a plurality of directed combustion jets. As suggested by broad arrows 20*a*, the combustion jet can then attack and perforate the walls of a tubular 30

The use of the combustion jet 20, provided by the fuel and oxidant mixture 9 allows a well-controlled attack on the target material (wall of tubular 30 in this example).

Referring to FIG. 1, in the illustrated example the tool 1 includes a cooling system 100, where cooling fluid 105 is pumped from the surface into the tool body 4 and exits via the nozzles 28. This way the chamber 6 is cooled whilst combustion takes place inside. In the illustrated example, the cooling system 100 is open. This means the supply of cooling fluid 105, for example water or seawater is not reused. A flow of cooling fluid 105 in the tool body actively cools the parts subject to heating e.g., the chamber 6 and nozzle(s) 26. The flow of cooling fluid 105 exits the tool body 4 via the outlet nozzles 28 into the tubular e.g. an oil well where the tool 1 is being used.

Figures 2, 2A:
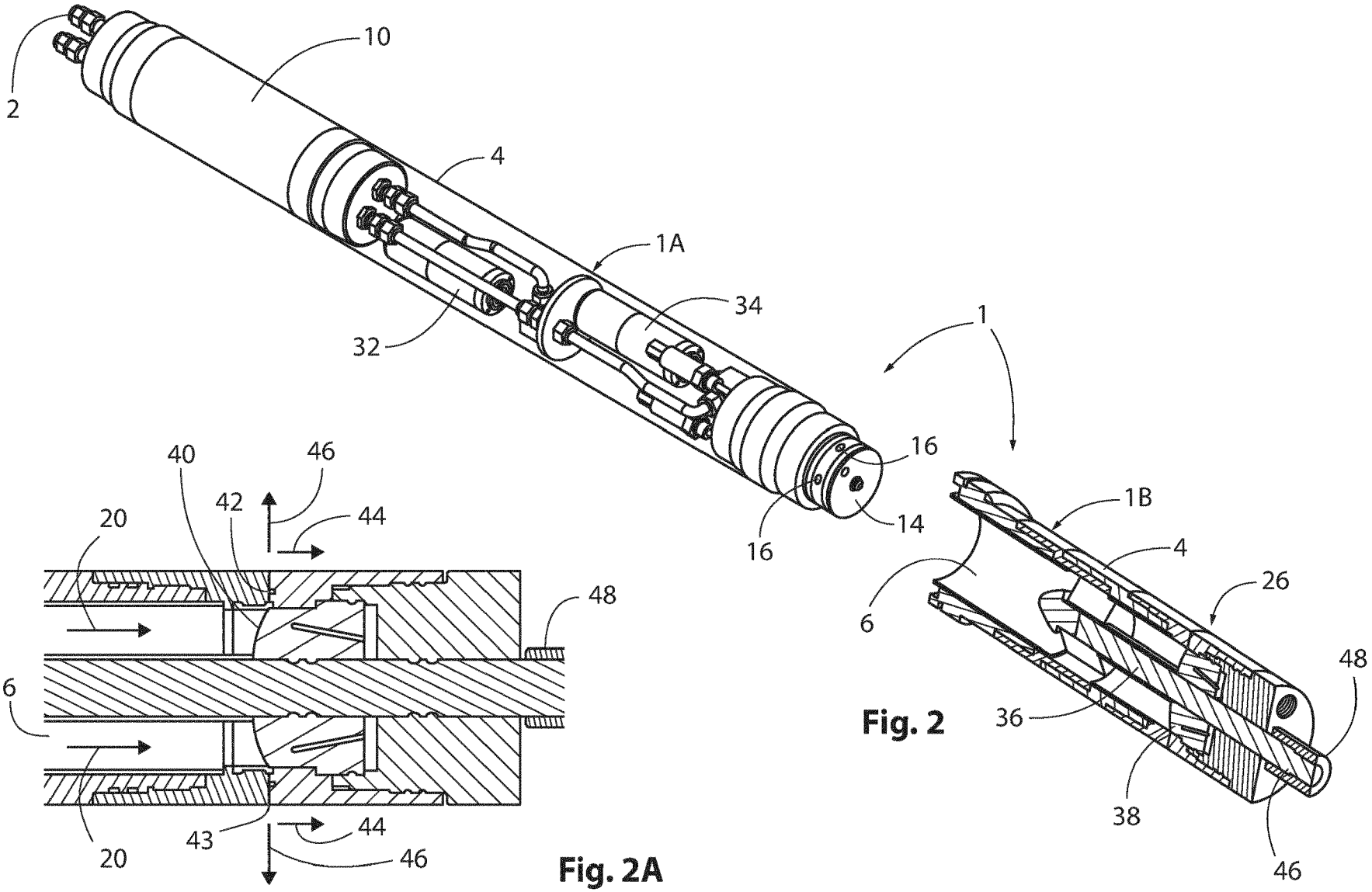
FIG. 2 shows an exemplary tool for severing a tubular in a schematic, partially dismantled perspective and cross section view.
FIG. 2A shows a cross section of the nozzle arrangement of the tool of FIG. 2.

FIG. 2 shows a downhole tool 1 with like parts numbered the same as in the tool of FIG. 1.

The tool 1 is shown in two parts in FIG. 2. Tool part 1A is shown in perspective with part of the wall of body 4 shown in ghost to allow viewing of the interior. Tool part 1B is shown in perspective cross section to allow viewing of the interior of the chamber 6 and related parts. In use the two parts 1A and 1B form a single generally cylindrical body 4.

In this example there are separate cylinders 32 and 34 containing an oxidant composition and a fuel composition respectively. Control module 10 commands operation of valving at injector head 14, allowing pressurised fuel and oxidant compositions to enter and be mixed. The mixed fuel and oxidant compositions are ignited by an ignition mechanism (not shown in this figure) as they leave injector head 14 via injector head nozzles 16. This produces a combustion jet in the chamber 6.

Chamber 6 includes a support rod 36 that mounts an end cap 38 of the chamber 6. End cap 38 includes a domed deflector 40 (see cross section FIG. 2A). End cap 38 seals to the rest of chamber 6 by an 'O' ring seal 42 at join 43.

The pressure produced in chamber 6 by the combustion jet (arrows 20) acts to slide end cap 38 along support rod 36 as suggested by arrows 44. Movement is prevented until the pressure in chamber 6 exceeds that required to break stop 46 mounted on rod 36 (FIG. 2). This allows end cap 38 to move until stopped by nut 48 at the extreme end of rod 36. Thus, an annular gap i.e. a nozzle, is opened around the body 4 of the tool at the previously sealed join 43. The combustion jet in the chamber can exit the annular gap, aided by deflection from the domed surface 40. This produces a circular disc combustion jet directed more or less orthogonally from the tool (arrows 46 in FIG. 2A).

If desired the end cap 38 may be provided with a supply of additional material for injection into the combustion jet. For example, a suspension of aluminium particles in liquid may be provided in a container (not shown) in end cap 38 and dispensed via nozzles exiting from domed surface 40.

Figure 3:
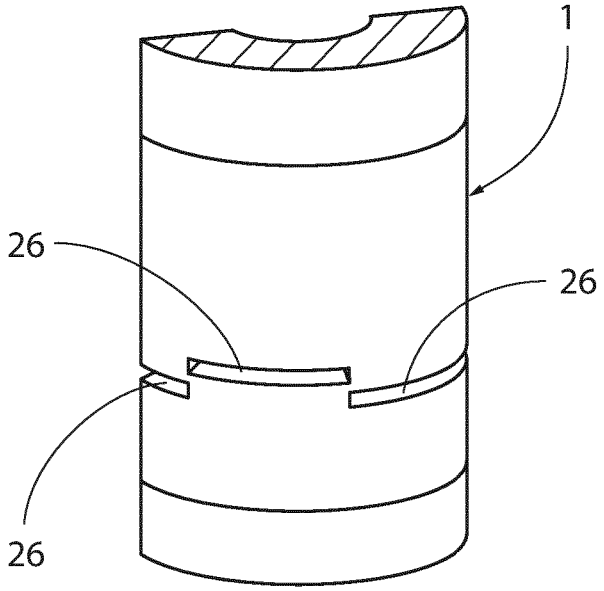
FIG. 3 shows a nozzle arrangement.

FIG. 3 shows schematically an end of a tool 1 that is cylindrical and includes a plurality of nozzles 26 that extend circumferentially around the tool. A plurality of combustion jets exiting from nozzles 26 can provide an effect similar to that of the tool of FIG. 2 i.e. a (generally) circular disc of overlapping combustion jets directed more or less orthogonally from the tool.

Figure 4:
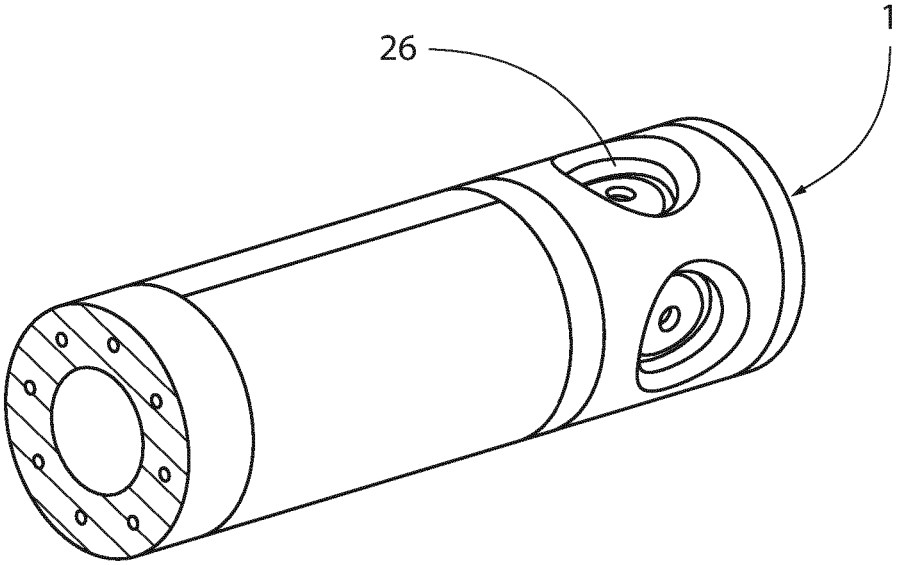
FIG. 4 shows another nozzle arrangement.

FIG. 4 shows schematically an end of a tool 1 that is cylindrical and includes a plurality of nozzles 26 that are of the convergent-divergent type as found in aerospace rocket engines. Such a design may be employed for perforation work downhole.

The invention claimed is:

1. A tool for manipulating a material, the tool comprising:

a body defining a chamber;

at least one source of a pressurised combustible, not classified as explosive, fuel and oxidant mixture, in fluid communication with the chamber via an injector device;

at least one nozzle, each nozzle having an inlet and an outlet, the inlet being in fluid communication with the chamber; and at least one mechanism for igniting the pressurized combustible, not classified as explosive, fuel and oxidant mixture;

wherein, upon ignition of the pressurized combustible, not classified as explosive, fuel and oxidant mixture, a combustion jet is formed in the chamber which, in use, flows out of the tool through each nozzle outlet as a plurality of directed combustion jets directed towards, and into engagement with, a material to be manipulated.

2. The tool of claim 1, wherein the tool is configured for use downhole.

3. The tool of claim 1 wherein the plurality of combustion jets emanate from the tool in a radially outwards 360 degree direction.

4. The tool of claim 1 further comprising a cooling system.

5. The tool of claim 1 wherein fuel and oxidant are provided separately to be mixed either before ignition or upon ignition.

6. The tool of claim 1 wherein gas pressure is employed to drive the combustible, not classified as explosive, fuel and oxidant mixture into the chamber.

7. The tool of claim 1 wherein the combustible, not classified as explosive, fuel and oxidant mixture is a gel composition.

8. The tool of claim 1, wherein the combustible, not classified as explosive, fuel and oxidant mixture is provided as a single composition including both fuel and oxidant.

9. The tool of claim 8, wherein the combustible fuel comprises an ionic liquid including a quaternary ammonium salt.

10. The tool of claim 8, wherein the combustible fuel comprises a solution including a quaternary ammonium salt.

11. The tool of claim 8, wherein the combustible fuel comprises at least one of:

a nitro alkane, an alkyl nitrate, or mixtures thereof; a hydrocarbon; and an alcohol.

12. The tool of claim 8 wherein the combustible, not classified as explosive, fuel and oxidant mixture comprises one of:

a) from 50 to 70% by weight of a quaternary ammonium salt ionic liquid;
from 5 to 25% by weight of a nitrate, chlorate, chromate, dinitramide or perchlorate salt, or mixtures thereof;
from 5 to 25% by weight of at least one metal selected from the group consisting of aluminum, magnesium, and alloys of aluminum and magnesium;
from 0 to 20% by weight of an alcohol; and
from 0.15 to 10% by weight of a gelling agent;

b) from 30 to 50% by weight of an alcohol;
from 35 to 55% by weight of a nitrate, chlorate, chromate, dinitramide or perchlorate salt, or mixtures thereof;
from 5 to 25% by weight of at least one metal selected from the group consisting of aluminum, magnesium, and alloys of aluminum and magnesium; and
from 0.15 to 10% by weight of a gelling agent; and c) from 50 to 70% by weight of a nitroalkane, a nitroalkene, an alkyl nitrate or mixtures thereof;
from 0 to 20% by weight of an alcohol;
from 5 to 25% by weight of at least one metal selected from the group consisting of aluminum, magnesium, and alloys of aluminum and magnesium;
from 10 to 30% by weight of a nitrate, chlorate, chromate, dinitramide or perchlorate salt, or mixtures thereof; and
from 0.15 to 10% by weight of a gelling agent.

13. The tool of claim 12 wherein the combustible, not classified as explosive, fuel and oxidant mixture further comprises particles of at least one selected from the group consisting of: aluminum, beryllium, iron, zirconium, magnesium, boron, boron carbide and alloys thereof.

14. A method of manipulating a material, the method comprising: deploying a tool according to claim 1 proximate a target material; and operating the tool to produce a plurality of combustion jets that engage the target material.

15. The method of claim 14 wherein the tool is a downhole tool and the tool is moved axially within a tubular to remove a selected length of tubular.

16. The method of claim 14 wherein the tool is a downhole tool and the tool is operated to perforate a tubular at a selected location or locations and is then moved to perforate the tubular at a further selected location or locations.

17. The method of claim 14 wherein the tool is rotated in use so as to direct the combustion jets in different directions around at least one selected location of the tool.

18. A tool for manipulating a material, the tool comprising:

a body defining a chamber;

at least one source of a pressurised combustible, not classified as explosive, fuel and oxidant mixture, in fluid communication with the chamber via an injector device;

at least one nozzle, each nozzle having an inlet and an outlet, the inlet being in fluid communication with the chamber; and at least one mechanism for igniting the combustible, not classified as explosive, fuel and oxidant mixture; and a cooling system wherein, upon ignition of the combustible, not classified as explosive, fuel and oxidant mixture, a combustion jet is formed in the chamber which, in use, flows out of the tool through each nozzle outlet as a plurality of directed combustion jets directed towards, and into engagement with, a material to be manipulated; and wherein the cooling system is open, wherein a cooling fluid is pumped from the surface into the tool body, flows around the tool body and exits via the nozzle outlets.

* * * * *